US007077364B2

(12) United States Patent
Hendzel

(10) Patent No.: US 7,077,364 B2
(45) Date of Patent: Jul. 18, 2006

(54) SELF-STORING MATERIAL-RECEPTACLE HANGER SYSTEM

(75) Inventor: Louis J. Hendzel, Owego, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/747,318

(22) Filed: Dec. 23, 2003

(65) Prior Publication Data

US 2005/0061930 A1 Mar. 24, 2005

Related U.S. Application Data

(60) Provisional application No. 60/504,328, filed on Sep. 19, 2003.

(51) Int. Cl.
*B65B 67/04* (2006.01)

(52) U.S. Cl. ..... 248/100; 248/95; 312/212; 312/246; 232/30; 232/48

(58) Field of Classification Search ..... 248/100, 248/298.1; 211/10, 12; 312/212, 246, 248, 312/309, 330.1; 232/30, 43.2, 48
See application file for complete search history.

(56) References Cited

U.S. PATENT DOCUMENTS

| | | | | |
|---|---|---|---|---|
| 688,198 | A * | 12/1901 | Saylor | 108/29 |
| 4,337,866 | A | 7/1982 | Suling et al. | |
| 4,921,194 | A | 5/1990 | Libby | |
| 5,048,785 | A | 9/1991 | Shaw et al. | |
| 5,050,743 | A | 9/1991 | Lazzarotti | |
| 5,340,099 | A | 8/1994 | Romanenko et al. | |
| 5,340,100 | A | 8/1994 | Romanenko et al. | |

* cited by examiner

*Primary Examiner*—Kimberly Wood
(74) *Attorney, Agent, or Firm*—Louis J. Franco; Leland D. Schultz; Patrick M. Hogan

(57) ABSTRACT

A material-receptacle hanger system includes a base frame and a channeling-panel support structure depending from the base frame and being adapted for reciprocation along a reciprocation axis between a rearwardmost retracted position and a forwardmost extended position with respect to the base frame. Pivotably attached to the channeling-panel support structure are front and rear material-channeling panels. Each channeling panel is pivotable about a panel pivot axis that extends along an axis extending orthogonal to the reciprocation axis. A set of receptacle-supporting linkage members depends from each panel for the selective support of a material receptacle such as a parcel or mail sack below the channeling-panel support structure.

11 Claims, 6 Drawing Sheets

Top, right and front view

Bottom, left and rear view

SELF-STORING MATERIAL-RECEPTACLE HANGER SYSTEM

PROVISIONAL PRIORITY CLAIM

Priority based on Provisional Application Ser. No. 60/504,328, filed Friday, Sep. 19, 2003, and entitled "SELF-STORING MATERIAL-RECEPTACLE HANGER SYSTEM," is claimed.

BACKGROUND

1. Field

Although not so limited in its utility or scope, implementations of the present invention are particularly well suited for incorporation in material sortation systems such as those used in moving mail pieces through various stages of processing in a mail processing facility, for example.

2. Brief Description of an Illustrative Environment and Related Art

Material handling operations frequently involve the use of transport systems including networks of conveyor belts, roller conveyors, conduits and chutes. In a typical material sorting environment, a material receptacle is located at each terminus of a selected plurality of termini for the collection of material exiting the sortation system. Commonly, a discharge chute corresponds to a terminus and includes a surface sloped downwardly toward the receptacle for guiding material exiting the sortation system into the receptacle situated below the chute. Illustrative, commonly used, material receptacles include flexible receptacles such as sacks and bags, for example, and rigid receptacles such as boxes, crates, cartons, and carts, for instance.

In a typical package or mail sortation system, multiple, adjacent discharge chutes are arranged along a base structure such as a longitudinally extending main framework adapted for supporting plural chutes. Each chute, and the receptacle corresponding thereto, is typically dedicated to guiding and retaining mail pieces destined for a particular geographical region. Depending on the level of sortation refinement to which a set of chutes and receptacles is dedicated, each chute within the set may be dedicated to mail pieces destined for a particular region of the country, a particular state, a region of a state identifiable by the first three or four digits of a ZIP Code or destination city, for example. A reality of mail sortation systems is that a small percentage of mail pieces exits the sortation apparatus prematurely (i.e., without settling in appropriate receptacles). Of the mail pieces that are unintentionally expelled from the sortation apparatus, a considerable percentage travel as far as the discharge chute and simply miss the receptacle and come to rest on the work area floor, thereby contributing to the "miss sort error" rate of the overall sortation system. For various reasons, sortation protocol in certain sorting facilities requires the reintroduction into the system of unintentionally expelled mail pieces. Consequently, unintentionally expelled mail pieces handled in accordance with the aforementioned protocol must be "double handled" by at least a portion of the mail sorting apparatus. As will be readily appreciated, since a given set of mail sortation apparatus can handle only a finite number of mail pieces per unit time, the "double handling" of mail pieces by any portion of the mail sorting apparatus decreases the efficiency of the overall sortation system.

In response to miss-sort errors in the vicinity of receptacles, sortation facility personnel have resorted to various improvised measures. For instance, it is not uncommon for sortation personnel to raise the front of a receptacle (i.e., the opening edge of the receptacle opposite the exit end of the discharge chute) with the intention of creating a "back stop" for mail pieces that might otherwise overshoot the receptacle. Such measures succeed to a limited extent, but nonetheless require the ad hoc intervention of personnel and, moreover, do not succeed to the same extent that a more permanent solution would.

Accordingly, there exists a need for a collapsible, selectively deployable material-receptacle hanger system adapted for directing into a predetermined receptacle material (e.g., mail pieces) discharged from a discharge chute.

SUMMARY

In a typical embodiment, a material-receptacle hanger system includes a base frame adapted for one of permanent and removable dependence from the main framework supporting a material-guiding discharge chute. Reciprocably depending from the base frame is a channeling-panel support structure adapted for rearward and forward reciprocating motion with respect to the base frame along a reciprocation axis between a rearwardmost retracted position and a forwardmost extended position. Variations of a channeling-panel support structure include laterally spaced right and left, elongated frame members extending along, but not necessarily parallel to, the reciprocation axis or to one another. Pivotably attached to the channeling-panel support structure, and extending between the right and left frame members, are front and rear material channeling panels. Each channeling panel pivots about a panel pivot axis that extends along an axis orthogonal to the reciprocation axis and that is non-coaxial with the pivot axis of the other channeling panel. Moreover, each channeling panel includes an inner face, and outer face, a base edge, a distal edge opposite the base edge, and left and right edges, the base edge being the edge, as between the base and distal edges, that is closer to the panel pivot axis.

In various embodiments, at least one receptacle-supporting linkage member (e.g., a hook, clip or chain) pivotally depends from each channeling panel. In a typical embodiment, one pivotable receptacle-supporting linkage member is located proximate the left and distal edges of a channeling panel and a second linkage member is located proximate the right and distal edges of the channeling panel. Moreover, each linkage member is typically pivotable about an axis extending along the panel pivot axis, although versions in which a linkage member pivots about an axis orthogonal to the panel pivot axis or in which a linkage member is attached to the panel by a universal joint, for example, are within the scope and contemplation of the invention.

In an illustrative environment, the base frame of the material-receptacle hanger system is either removably or permanently attached to a framework such that the base frame is disposed underneath the forwardly declining surface of a material-guiding chute. Typically, such a chute further includes material-guiding side walls depending upwardly from the forwardly declining surface and a material discharge (or drop-off) edge defining the terminus of the forwardly declining surface. As discussed in more detail below, the hanger system is selectively positionable into alternative storage and operative attitudes or states below such a chute.

In a typical embodiment, each of the front and rear channeling panels is pivotable, independently of the other channeling panel, between a collapsed position in which the channeling panel extends along a horizontal plane and a deployed position in which the channeling panel extends relatively vertically with the distal edge of the channeling panel being disposed below the base edge and below the channeling-panel support structure. The front and rear panel pivot axes are spaced apart such that, at least when the front and rear channeling panels are in deployed positions, there exists between the base edges of the front and rear channeling panels an open material acceptance region through which material can descend to a predetermined location (e.g., a material receptacle) below the acceptance region.

One illustrative storage attitude is one in which the channeling-panel support structure has been urged rearwardly toward its rearwardmost position with respect to the base frame and in which the channeling panels are permitted to hang freely such that they extend downwardly under the influence of gravity in, for example, the deployed state. An alternative illustrative storage attitude is one in which the channeling panels are collapsed (or folded) and the channeling-panel support structure has been urged rearwardly toward its rearwardmost position with respect to the base frame. Various versions include at least one panel retainer (e.g., a clip, pin or magnet) for selectively retaining at least one of the channeling panels in a collapsed position for storage. In some variations, there is a panel retainer corresponding to each of the front and rear panels. In accordance with alternative variations, the front and rear panels are fabricated, mounted and collapsible to such an extent that one of (i) at least a portion of the inner face of the front panel is overlayingly juxtaposed (e.g., overlapped, but not necessarily in contacting engagement) with a portion of the outer face of the rear panel and (ii) at least a portion of the inside face of the rear panel is overlayingly juxtaposed with a portion of the outer face of the front panel. In some versions in which the front and rear panels collapse so as to be overlayingly juxtaposed, a single set of panel retainers including at least one panel retainer selectively retains one of the front and rear panels in a collapsed position while the other of the front and rear panels is supported in a collapsed position by the inside face of the panel retained by the panel retainer set.

In an illustrative environment in which the base frame is disposed underneath the forwardly declining surface of a material-guiding chute, a storage attitude is, furthermore, typically one in which the channeling-panel support structure is sufficiently retracted that at least a majority portion of the length of the collapsed front panel, between the base and distal edges, is disposed rearwardly of the chute discharge edge. A collapsed position is, furthermore, typically characterized in that the front and rear channeling panels are pivoted inwardly toward one another such that their distal edges are brought into relatively close proximity to one another, although, it is to be understood, that embodiments in which the panels are collapsed by pivoting them outwardly away from one another are within the scope and contemplation of the invention.

In still further embodiments, the base frame is mounted for pivotable motion about a vertically extending mount axis such that the channeling panel support structure can be pivoted clockwise and counterclockwise along a horizontal plane.

Representative embodiments of the invention are more completely described and depicted in the following detailed description and the accompanying drawings.

DETAILED DESCRIPTION

The following description of various embodiments of a material-receptacle hanger system is illustrative in nature and is therefore not intended to limit the scope of the invention or its application of uses.

Figure 1A:
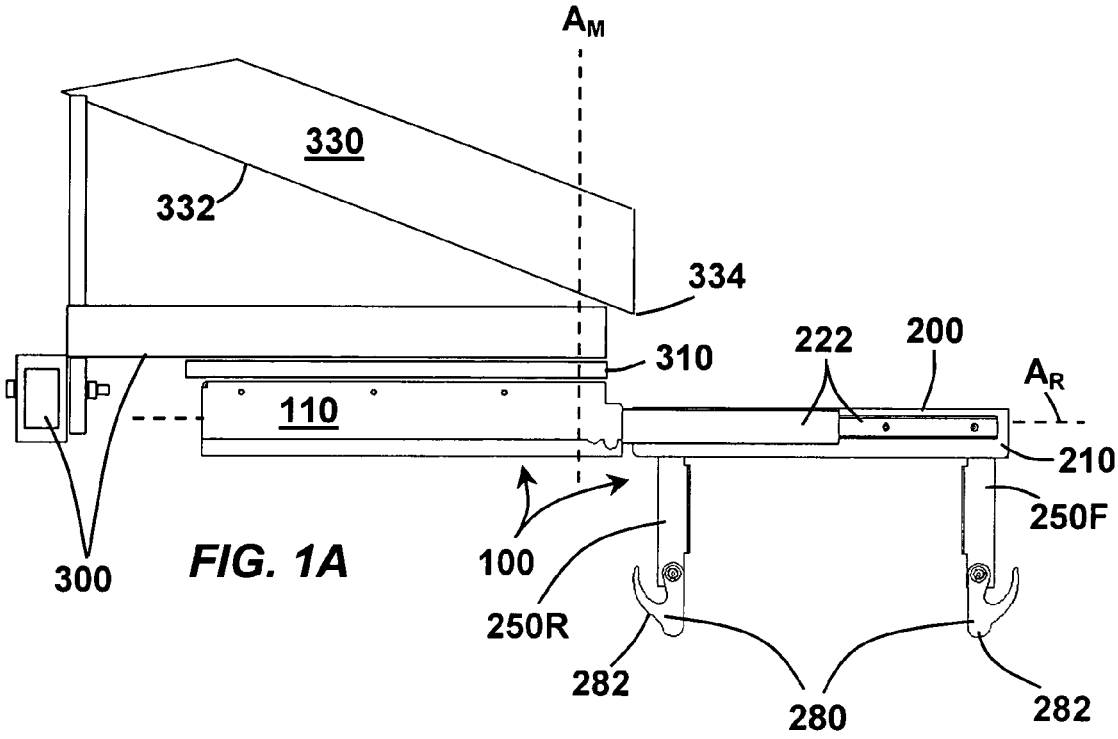
FIG. 1A is a left side view of an illustrative material-receptacle hanger system in an operative attitude with front and rear material channeling panels in a deployed state.
Figure 1B:
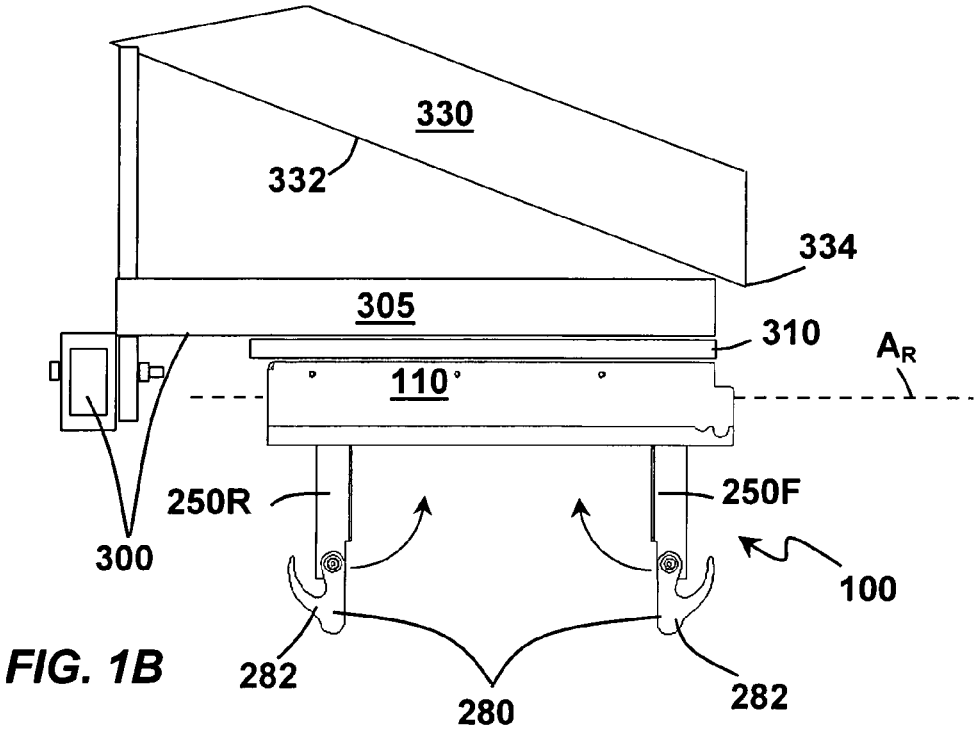
FIG. 1B is a left side view of the system of FIG. 1 in one illustrative storage attitude in which the channeling panel support structure is in a retracted position and the front and rear material channeling panels are in a deployed state.
Figure 2:
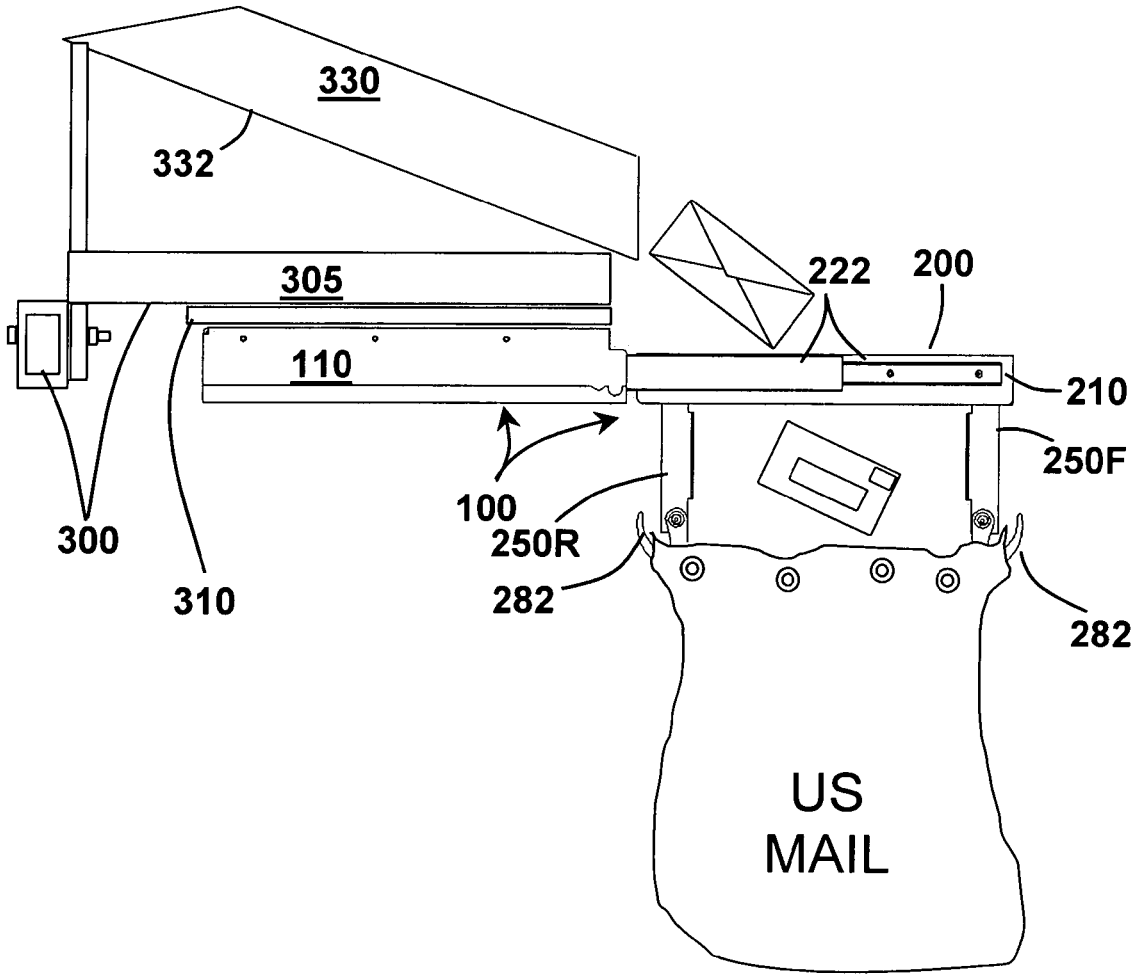
FIG. 2 shows the material-receptacle hanger system of FIGS. 1A and 1B in an operative attitude and supporting a mail sack.
Figure 3:
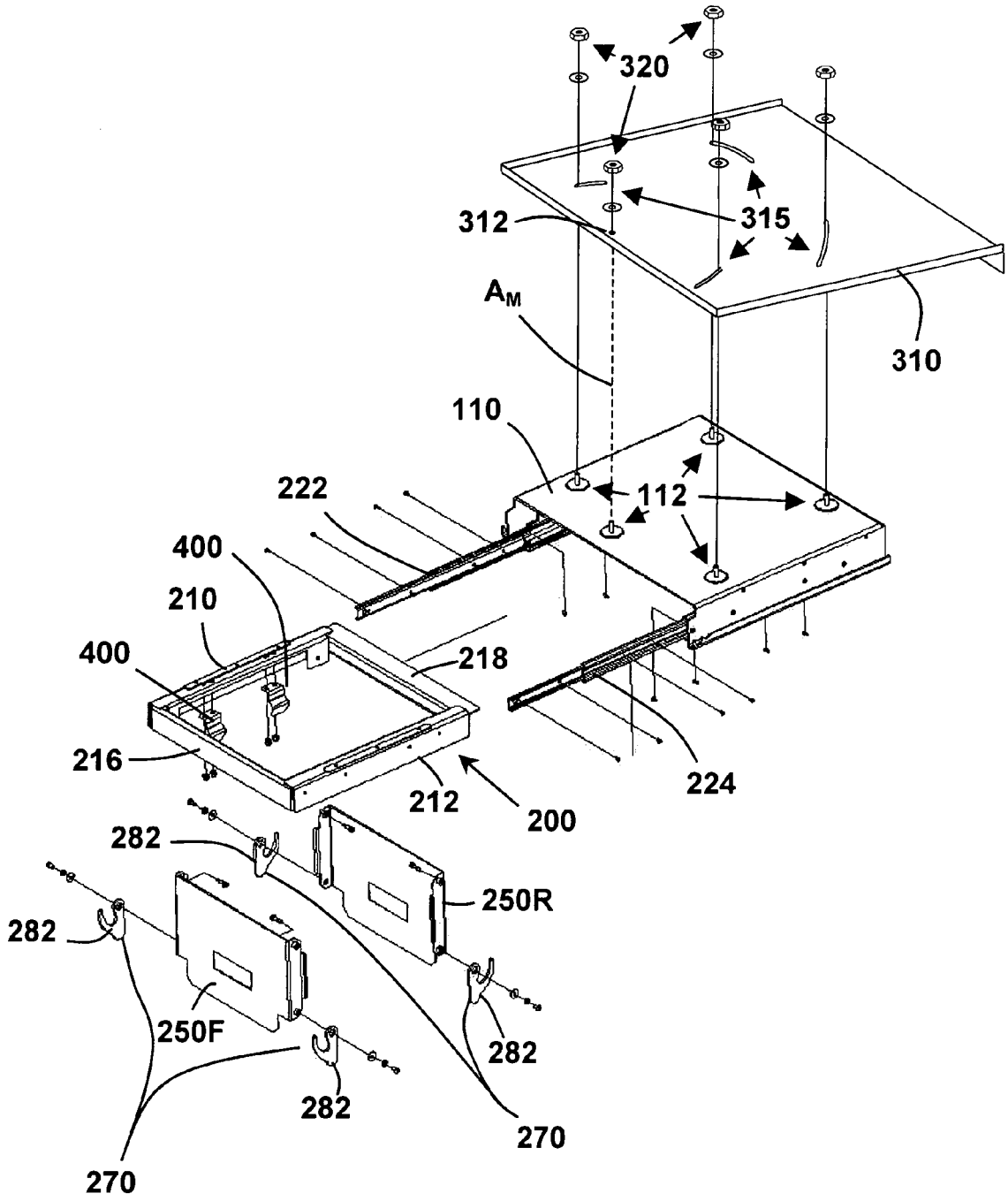
FIG. 3 is an exploded view of a material-receptacle hanger system.

Referring to FIG. 1A through 2, and the exploded view of FIG. 3, an illustrative material-receptacle hanger system 100 includes a base frame 110 mounted to the main framework 300 supporting a material-guiding discharge chute 330. The base frame 110 is mounted such that it is underneath the forwardly declining surface 332, and extends rearwardly of the discharge edge 334, of the chute 330.

Figure 4:
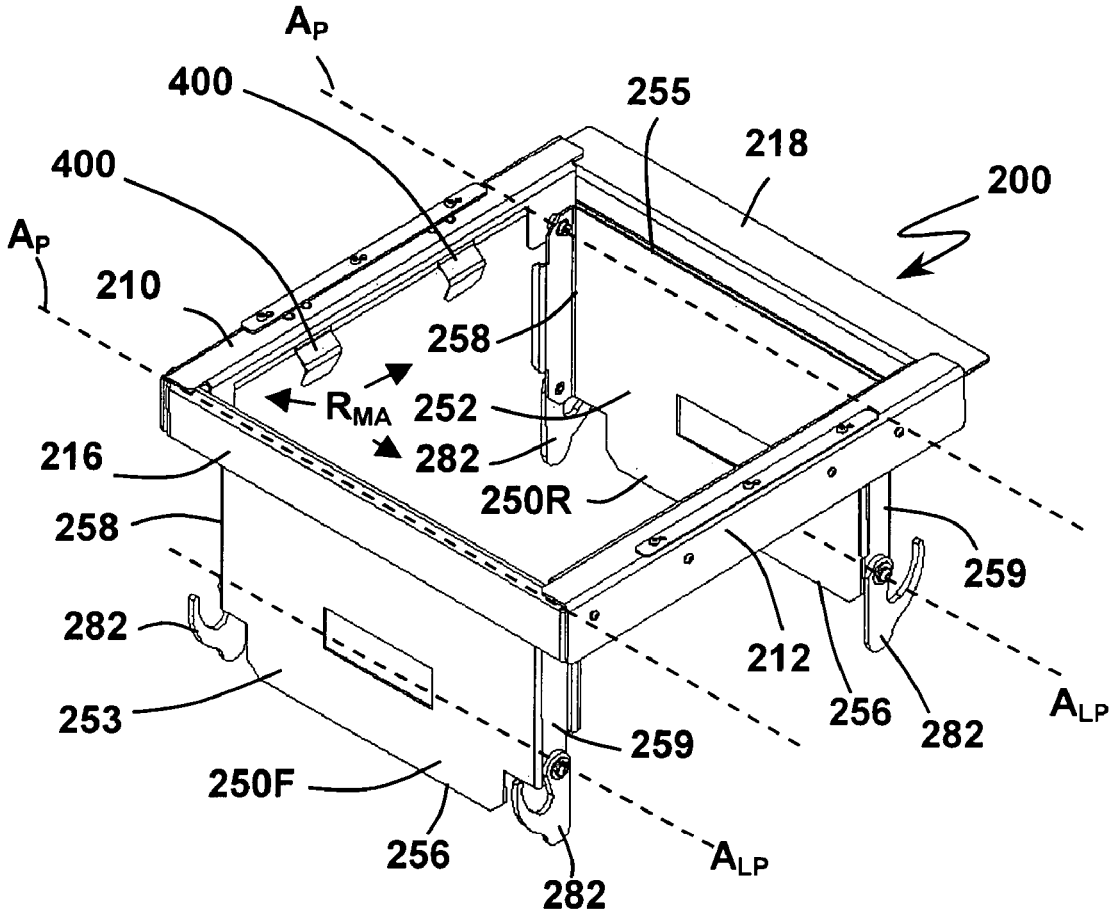
FIG. 4 is a top right side view of the channeling-panel support structure of a material-receptacle hanger system with channeling panels and receptacle-supporting linkage members attached thereto.
Figure 5:
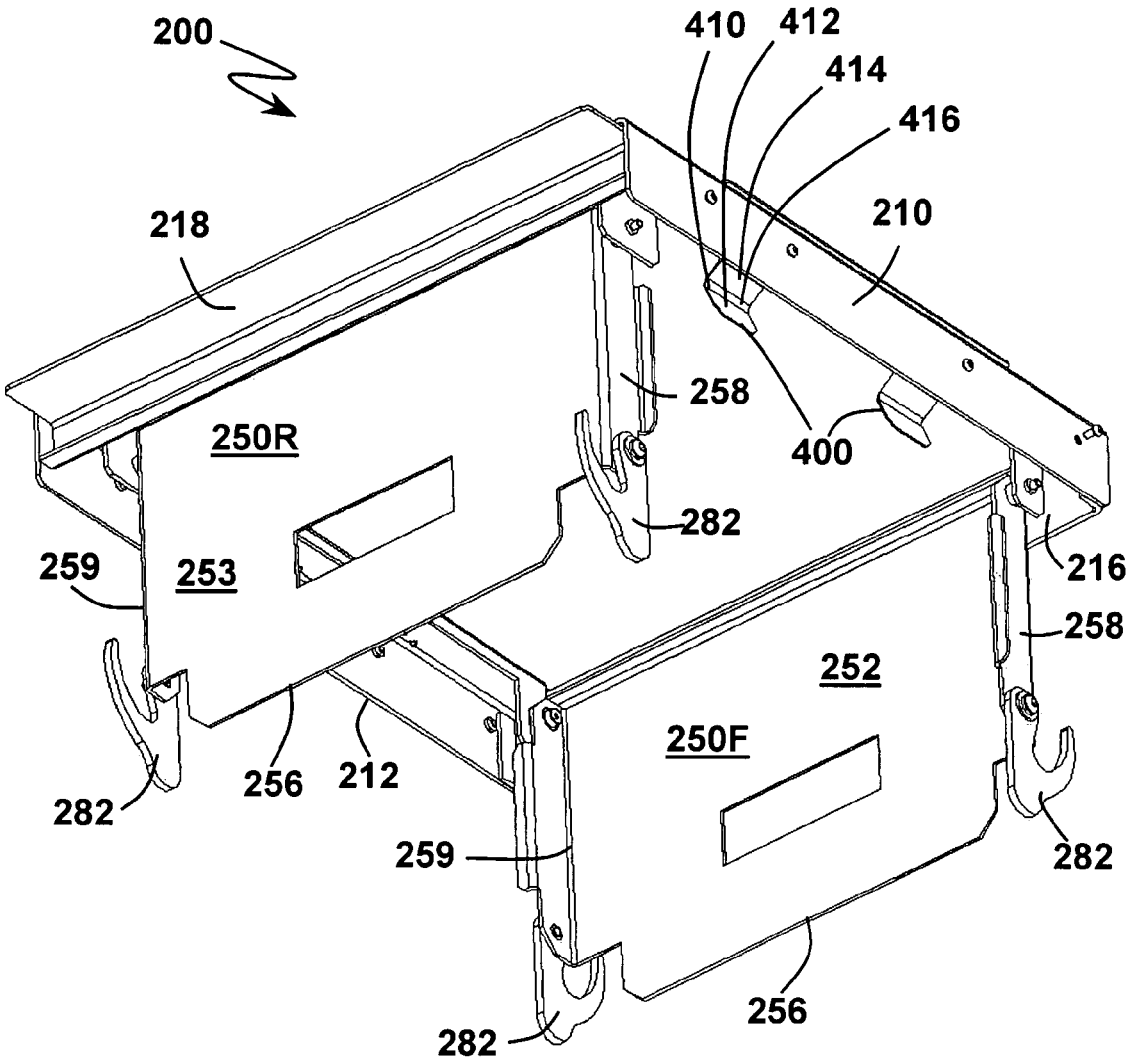
FIG. 5 is a bottom, left and rear side view of the channeling-panel support structure of FIG. 4.

A channeling-panel support structure 200 reciprocably depends from the base frame 110 and is adapted for rearward and forward reciprocating motion with respect to the base frame 110 along a reciprocation axis $A_R$ between a rearwardmost retracted position and a forwardmost extended position as shown in, respectively, FIGS. 1B and 1A. As shown in FIGS. 3 through 5, the illustrative embodiment of FIGS. 1 through 5 includes a channeling-panel support structure 200 having laterally spaced left and right elongated frame members 210 and 212 and front and rear transverse beams 216 and 218 extending between and bridging the left and right frame members 210 and 212. In the particular embodiment illustrated, left and right slides 222 and 224 interconnect the base frame 110 and the channeling-panel support structure 200 and facilitate the reciprocating motion of the channeling-panel support structure 200 with respect to the base frame 110. The slides 222 and 224 depicted resemble drawer slides and are similar in operation, although the channeling-panel support structure 200 can be alternatively mounted for rearward and forward reciprocal motion, as the specific manner in which the channeling-panel support structure 200 is made to reciprocably depend from the base frame 110 is of no particular relevance.

Pivotably depending from the channeling-panel support structure 200, and extending between the right and left frame members 210 and 212, are front and rear material channeling panels 250F and 250R. As shown in FIG. 4, each of the front and rear channeling panels 250F and 250R pivots about a panel pivot axis $A_P$ that extends along, but not necessarily parallel to, an axis (not shown) orthogonal to the reciprocation axis $A_R$ and non-coaxial with the other pivot axis $A_P$. Each of the front and rear channeling panels 250F and 250R includes an inner face 252, an outer face 253, a base edge 255, a distal edge 256 opposite the base edge 255, and left and right edges 258 and 259, the base edge 255 being the edge, as between the base and distal edges 255 and 256, that is closer to the panel pivot axis $A_P$.

A set of receptacle-supporting linkage members 270 pivotably depends from each of channeling panels 250F and 250R. More specific to the illustrative embodiments depicted, each of the front and rear channeling panels 250F and 250R includes a pivotably mounted receptacle-supporting linkage member 280 proximate to its left and distal edges 258 and 256 and its right and distal edges 259 and 256. Moreover, in the embodiments illustrated, each receptacle-supporting linkage member 280 is in the form of a hook 282 mounted to a respective one of panels 250F and 250R for pivotable motion about a linkage pivot axis $A_{LP}$ (depicted in FIG. 4) that extends along, but necessarily parallel to, an axis (not shown) that extends orthogonal to the reciprocation axis $A_R$. As alluded to in the summary, alternative embodiments include receptacle-supporting linkage members 280 other than hooks such as clips, cables, wire, chain, C-links, tethers and straps. Receptacle-supporting linkage members 280 mounted for movement along axes other than axes extending along an axis orthogonal to the reciprocation axis $A_R$, including universally mounted receptacle-supporting linkage members 280, are also within the scope and contemplation of the invention. FIG. 2 depicts the material-receptacle hanger system 100 in an operative attitude with hooks 282 supporting a mail sack including a plurality of grommets each of which grommets is adapted to receive a hook 282 or other receptacle-supporting linkage member 280.

In various versions, including the versions depicted in the drawings, each of the front and rear channeling panels 250F and 250R is pivotable between (i) a deployed position in which the channeling panel extends relatively vertically with the distal edge 256 of the channeling panel 250 being disposed below the base edge 255 and below the channeling-panel support structure 200 and (ii) a collapsed position in which the panel 250 extends along, but not necessarily parallel to, a horizontal plane. The deployed position is shown in several of the drawings, while the ability to fold into a collapsed position is indicated by arcuate arrows in FIG. 1B. The panel pivot axes $A_P$ are spaced apart such that, at least when the front and rear channeling panels 250F and 250R are in deployed positions, there exists between the base edges 255 of the front and rear channeling panels 250F and 250R an open material acceptance region $R_{MA}$ through which material can descend to a predetermined location (e.g., a material receptacle, such as a mail sack) below the acceptance region $R_{MA}$.

As shown in FIGS. 3, 4 and 5, the channeling-panel support structure 200 includes a panel retainer 400 corresponding to each of the front and rear channeling panels 250F and 250R. Each panel retainer 400 is adapted for selectively retaining a corresponding one of the front and rear panels 250F and 250R in a collapsed state and, as shown FIG. 5, comprises a resilient member 410 including first and second oppositely sloped surfaces 412 and 414 joined at a region 416 that is in the path of one of the left and right edges 258 and 259 of a panel 250 such that, as the panel 250 is pivoted toward a fully collapsed position, the panel 250 engages the first sloped surface 412 and flexes the resilient member 410 until the panel 250 clears the region 416 and the resilient member 410 returns toward an unflexed position to permit the panel 250 to come into resting supportive engagement with the second sloped surface 414. The panel 250 can be released from retention by the panel retainer 400 either by a user's flexing the resilient member 410 out of the panel path directly or by applying sufficient downward force on the panel 250 to flex the resilient member 410 out of the path of the panel 250.

In alternative embodiments, including the illustrative embodiment of FIGS. 1A through 3, the base frame 110 of the material-receptacle hanger system 100 is mounted to the framework 300 such that the material-receptacle hanger system 100 is pivotable about a vertically extending mount axis $A_M$ along, but not necessarily parallel to, a horizontal plane. In the particular version of FIGS. 1A through 3, the chute-supporting framework 300 includes a pair of horizontally extending arms 305 of which only one arm is visible in the left side views of FIGS. 1A, 1B and 2. Supported by, and extending between, the arms 305 is a mounting plate 310. Referring to the exploded view of FIG. 3, the mounting plate 310 includes a pivot-point aperture 312 and a plurality of arcuate apertures 315 each of which arcuate apertures 315 traces an arc along an imaginary circle centered at the pivot-point aperture 312. Extending upwardly from the base frame 110 is a rod-like threaded fastener 112 (e.g., an externally threaded bolt) corresponding to each of (i) the pivot point aperture 312 and (ii) a selected set of the arcuate apertures 315. When each rod-like threaded fastener 112 is caused to extend upwardly through its corresponding aperture 312 or 315, and a mating fastener (e.g., an internally threaded nut 320) is threadably coupled therewith, the base frame 110 is supported by the mounting plate 310. Moreover, when supported by the mounting plate 310, the base frame 110 is pivotable about the fastener 112 extending through the pivot-point aperture 312, and along the mount axis $A_M$, as long as none of the coupled fastener sets is tightened to extent that prevents such pivotable motion of the base frame 110 with respect to the mounting plate 310. In various versions, the base frame 110 is selectively fixable into each position of a predetermined set of positions with respect to the mounting plate 310 by sufficiently tightening one or more of the fastener sets. The arcuate apertures 315 in the mounting plate 310 of FIG. 3 render the base frame 110 infinitely positionable between extreme clockwise and counter-clockwise angular positions.

Figure 6:
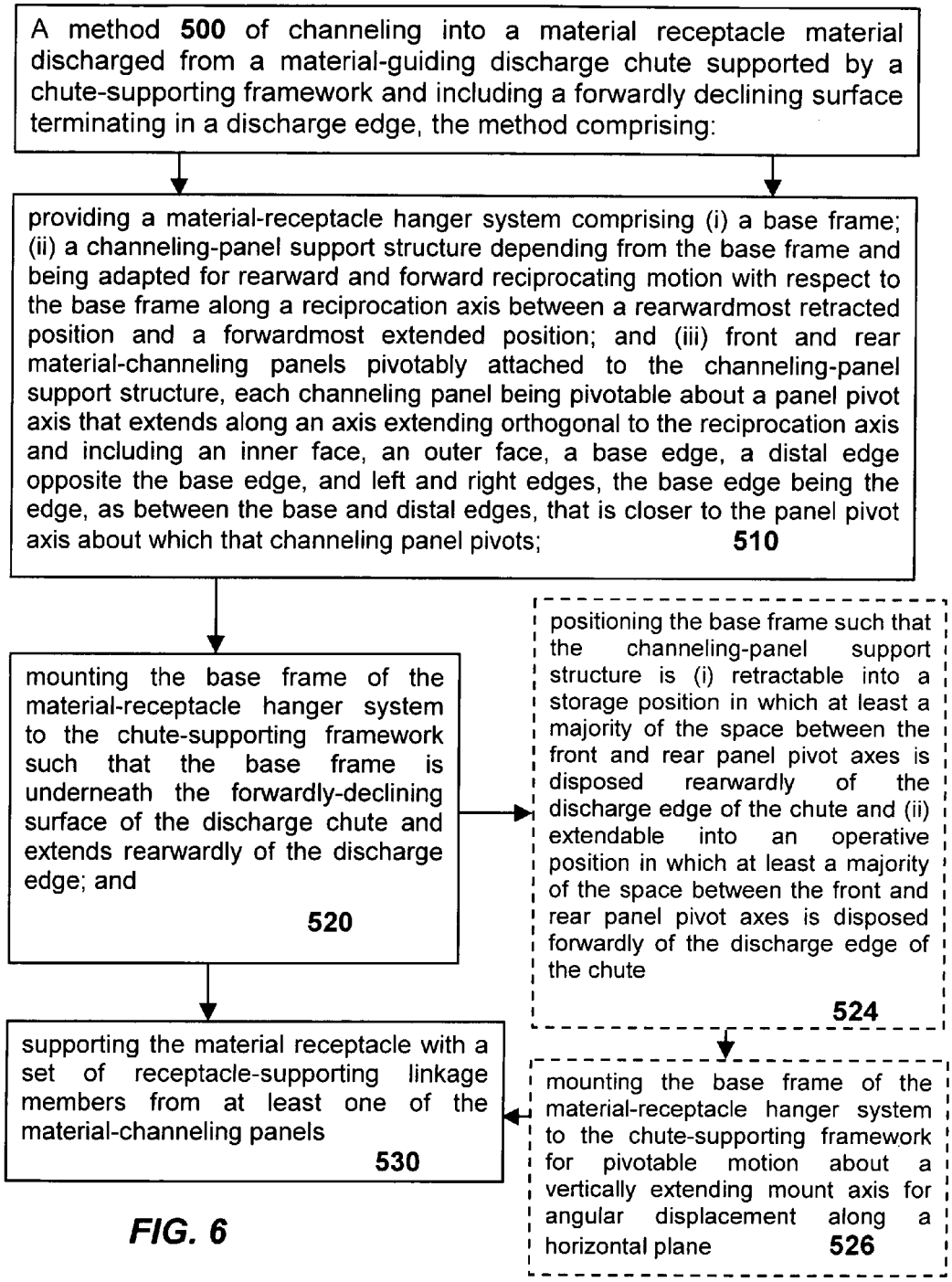
FIG. 6 includes steps in an illustrative method of channeling material discharged from a chute into a receptacle situated below the chute.

In conjunction with FIGS. 1A through 6, an illustrative method of channeling into a material receptacle material discharged from a material-guiding discharge chute 330 supported by a chute-supporting framework 300 and including a forwardly declining surface 332 terminating in a discharge edge 334 is now described. Referring to FIG. 6, a sequence of method steps includes steps for mounting a material-receptacle hanger system 100 in cooperative proximity with a discharge chute 330. It should be noted that the sequence of steps presented in the drawing and the text to follow is illustrative only and not necessarily indicative of the order in which the steps must be performed. Accordingly, nothing in the drawings, this description or the corresponding claims should be construed so as to limit the scope of the invention to a particular sequence of steps in the absence of explicit statements to the contrary or unless a particular order is inextricably dictated by context (e.g., an instance in which it is impossible to perform a particular step prior to the performance of another step.).

The illustrative method 500 illustrated in FIG. 6 includes a step 510 of providing a material-receptacle hanger system 100 having (i) a base frame 110; (ii) a channeling-panel support structure 200 depending from the base frame 110 and being adapted for rearward and forward reciprocating motion with respect to the base frame 110 along a reciprocation axis $A_R$ between a rearwardmost retracted position and a forwardmost extended position; and (iii) front and rear material-channeling panels 250F and 250R pivotably attached to the channeling-panel support structure 200, each channeling panel 250F and 250R being pivotable about a panel pivot axis $A_P$ that extends along an axis extending orthogonal to the reciprocation axis $A_R$ and including an inner face 252, an outer face 253, a base edge 255, a distal edge 256 opposite the base edge 255, and left and right edges 258 and 259, the base edge 255 being the edge, as between the base and distal edges 255 and 256, that is closer to the panel pivot axis $A_P$ about which that channeling panel 250 pivots.

At 520, the base frame 110 of the material-receptacle hanger system 100 is mounted to the chute-supporting framework 300 such that the base frame 110 is underneath the forwardly-declining surface 332 of the discharge chute 330 and extends rearwardly of the discharge edge 334.

At step 530, the material receptacle is supported from at least one of the material-channeling panels 250 with a set of receptacle-supporting linkage members 270.

In alternative implementations, the step 520 of mounting the base frame 110 further includes a step 524 of positioning the base frame 110 such that the channeling-panel support structure 200 is (i) retractable into a storage position in which at least a majority of the space between the front and rear panel pivot axes AP is disposed rearwardly of the discharge edge 334 of the chute 330 and (ii) extendable into an operative position in which at least a majority of the space between the front and rear panel pivot axes AP is disposed forwardly of the discharge edge 334 of the chute 330.

In accordance with still additional implementations, the step 520 of mounting the base frame 110 further includes a step 526 of mounting the base frame 110 of the material-receptacle hanger system 100 to the chute-supporting framework 300 for pivotable motion about a vertically extending mount axis $A_M$ for angular displacement along a horizontal plane. Just as the particular components and mechanisms used to implement each of the other method steps is not considered material, the particular components and mechanisms implemented to facilitate angular displacement of the base frame 110 about a vertically extending mount axis $A_M$ is of no particular relevance to the implementation of step 526.

As alluded to throughout the specification, the description of the movement or extension of an element as being "along" a referenced plane or axis, for example, does not necessarily mean that such movement or extension is along a plane or axis that is parallel to the referenced plane or axis. For instance, a line oriented at an angle of 40 degrees in an x-y Cartesian grid may be said to "extend along" the x-axis because the magnitude of the x-component of any point along that line is greater than the corresponding y-component. Moreover, the description of a line or axis, for example, as "vertically extending" is to be read as "extending along a vertical axis." Accordingly, a vertically extending axis is not necessarily truly vertical; instead such an axis extends along, but not necessarily parallel to, an axis that is truly vertical. It is in this spirit that like terminology is to be construed for purposes of this specification and the appended claims.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact construction, implementations and versions shown and described.

What is claimed is:

1. A material-receptacle hanger system comprising:

a base frame;

a channeling-panel support structure depending from the base frame and being adapted for rearward and forward reciprocating motion with respect to the base frame along a reciprocation axis between a rearwardmost retracted position and a forwardmost extended position;

front and rear material-channeling panels pivotably attached to the channeling-panel support structure, each channeling panel being pivotable about a panel pivot axis that extends along an axis extending orthogonal to the reciprocation axis and including an inner face, an outer face, a base edge, a distal edge opposite the base edge, and left and right edges, the base edge being the edge, as between the base and distal edges, that is closer to the panel pivot axis about which that channeling panel pivots; and at least one receptacle-supporting linkage member pivotably depending from at least one of the front and rear material-channeling panels, wherein each of the front and rear channeling panels is pivotable, independently of the other channeling panel, between a collapsed position in which the panel extends along, but not necessarily parallel to, a horizontal plane and a deployed position in which the channeling panel extends relatively vertically with the distal edge of the channeling panel being disposed below the base edge and below the channeling-panel support structure, the front and rear panel pivot axes being non-coaxial and spaced apart such that, at least when the front and rear channeling panels are in deployed positions, there exists between the base edges of the front and rear channeling panels an open material acceptance region through which material can descend to a predetermined location below the acceptance region.

2. The material-receptacle hanger system of claim 1 wherein the channeling-panel support structure comprises elongated, laterally spaced left and right frame members that extend along the reciprocation axis and between which the front and rear channeling panels extend.

3. The material-receptacle hanger system of claim 1 further comprising at least one panel retainer for selectively retaining at least one channeling panel in a collapsed position.

4. The material-receptacle hanger system of claim 3 wherein at least one of the at least one receptacle-supporting linkage members comprises a hook.

5. The material-receptacle hanger system of claim 1 wherein at least one of the at least one receptacle-supporting linkage members comprises a hook.

6. The material-receptacle hanger system of claim 5 wherein the channeling-panel support structure comprises elongated, laterally spaced left and right frame members that extend along the reciprocation axis and between which the front and rear channeling panels extend.

7. The material-receptacle hanger system of claim 6 wherein a set of receptacle-supporting linkage members pivotably depends from each of the front and rear material-channeling panels and wherein each set of receptacle-supporting linkage members comprises at least one receptacle-supporting linkage member.

8. The material-receptacle hanger system of claim 1 wherein the base frame is mountable to a framework such that the material-receptacle hanger system is pivotable about a vertically extending mount axis for angular displacement along a horizontal plane.

9. A material-receptacle hanger system comprising:

a base frame;

a channeling-panel support structure depending from the base frame and being adapted for rearward and forward reciprocating motion with respect to the base frame along a reciprocation axis between a rearwardmost retracted position and a forwardmost extended position, the channeling-panel support structure comprising elongated, laterally spaced left and right frame members that extend along the reciprocation axis;

front and rear material-channeling panels pivotably attached to the channeling-panel support structure, each channeling panel (i) extending between the laterally spaced left and right frame members, (ii) being pivotable about a panel pivot axis that extends along an axis extending orthogonally to the reciprocation axis, but non-coaxially with the panel pivot axis of the other of the front and rear channeling panels and (iii) including an inner face, an outer face, a base edge, a distal edge opposite the base edge, and left and right edges, the base edge being the edge, as between the base and distal edges, that is closer to the panel pivot axis about which that channeling panel pivots; and a set of receptacle-supporting linkage members depending from each of the front and rear material-channeling panels, each set of receptacle-supporting linkage members comprising at least one receptacle-supporting linkage member.

10. The material-receptacle hanger system of claim 9 wherein each of the front and rear channeling panels is pivotable between a collapsed position in which the panel extends along, but not necessarily parallel to, a horizontal plane and a deployed position in which the channeling panel extends relatively vertically with the distal edge of the channeling panel being disposed below the base edge and below the channeling-panel support structure, the front and rear panel pivot axes being spaced apart such that, at least when the front and rear channeling panels are in deployed positions, there exists between the base edges of the front and rear channeling panels an open material acceptance region through which material can descend to a predetermined location below the acceptance region.

11. The material-receptacle hanger system of claim 10 further comprising at least one panel retainer for selectively retaining at least one channeling panel in a collapsed position.

* * * * *